US011225937B2

(12) United States Patent
Teng et al.

(10) Patent No.: US 11,225,937 B2
(45) Date of Patent: Jan. 18, 2022

(54) SINGLE-HOLE FUEL ATOMIZATION AND INJECTION DEVICE AND FRONT-FACING ATOMIZATION STRUCTURE THEREOF

(71) Applicant: GUANGXI CARTIER TECHNOLOGY CO., LTD., Guangxi (CN)

(72) Inventors: Yu Teng, Guangxi (CN); Yongxue Li, Guangxi (CN)

(73) Assignee: GUANGXI CARTIER TECHNOLOGY CO., LTD., Guangxi (CN)

( * ) Notice: Subject to any disclaimer, the term of this patent is extended or adjusted under 35 U.S.C. 154(b) by 27 days.

(21) Appl. No.: 16/766,298

(22) PCT Filed: Apr. 24, 2018

(86) PCT No.: PCT/CN2018/084176
§ 371 (c)(1),
(2) Date: May 22, 2020

(87) PCT Pub. No.: WO2019/100657
PCT Pub. Date: May 31, 2019

(65) Prior Publication Data

US 2020/0370526 A1 Nov. 26, 2020

(30) Foreign Application Priority Data

Nov. 24, 2017 (CN) ..... 201711193782.5

(51) Int. Cl.
*F02M 61/18* (2006.01)
*F02M 51/06* (2006.01)
*F02M 61/04* (2006.01)

(52) U.S. Cl.
CPC ..... *F02M 61/1806* (2013.01); *F02M 51/061* (2013.01); *F02M 61/04* (2013.01)

(58) Field of Classification Search
CPC ..... F02M 61/186; F02M 61/162; F02M 61/1853; F02M 61/1806; F02M 61/04; F02M 51/061
See application file for complete search history.

(56) References Cited

U.S. PATENT DOCUMENTS 4,828,184 A * 5/1989 Gardner ..... B05B 1/34 239/590.3
4,971,254 A 11/1990 Daly et al.
(Continued)

FOREIGN PATENT DOCUMENTS

CN 2195037 Y 4/1995
CN 1262717 A 8/2000
(Continued)

OTHER PUBLICATIONS

International Search Report for PCT/CN2018/084176 dated Sep. 7, 2018, ISA/CN.

*Primary Examiner* — Joseph A Greenlund
(74) *Attorney, Agent, or Firm* — Yue (Robert) Xu; Apex Attorneys at Law, LLP

(57) ABSTRACT

A front atomization structure of a single-hole atomization fuel injector comprises a tube, an installation sleeve, a valve base, a flow splitter, an overflow member, a rotating flow member, and a metering member. Splitting recesses are arranged at the flow splitter to split a flow into a plurality of streams. An overflow hole is arranged at the overflow member to further limit the stream of the split flow. A rotating flow hole and a rotating flow recess are arranged at the rotating flow member. Upon passing the rotating flow recess, the stream of the split flow impacts a bottom portion of the rotating flow recess blocked by the metering member to form a turbulent stream which converges toward the
(Continued)

rotating flow hole. Also provided is a single-hole fuel atomization and injection device.

16 Claims, 4 Drawing Sheets

(56) References Cited

U.S. PATENT DOCUMENTS 6,065,692 A * 5/2000 Brinn, Jr. ..... F02M 51/0671 239/463
6,161,782 A 12/2000 Heinbuck et al.
6,168,094 B1 1/2001 Schatz et al.
6,273,349 B1 * 8/2001 Fischbach ..... F02M 61/162 239/585.1
6,755,347 B1 * 6/2004 Holz ..... F02M 61/162 239/491
8,464,539 B2 * 6/2013 Pelletier ..... F02C 7/22 60/742
2003/0116641 A1 * 6/2003 Ohnishi ..... F02M 51/061 239/102.1
2003/0121998 A1 * 7/2003 Maier ..... F02M 61/162 239/585.1
2003/0121999 A1 * 7/2003 Huebel ..... F02M 51/0671 239/585.1
2003/0141385 A1 * 7/2003 Xu ..... F02M 61/1853 239/463
2003/0234005 A1 * 12/2003 Sumisha ..... F02M 61/1853 123/467
2004/0098989 A1 * 5/2004 Mansour ..... B05B 7/0458 60/775
2005/0284965 A1 * 12/2005 Schneider ..... F02M 61/186 239/533.12
2011/0233307 A1 * 9/2011 Ohno ..... F02M 61/162 239/463
2012/0193566 A1 * 8/2012 Yasukawa ..... F02B 31/00 251/366
2014/0027542 A1 * 1/2014 Yoshimura ..... F02M 61/1853 239/489
2014/0252132 A1 9/2014 Jeannel et al.
2016/0356253 A1 12/2016 Noguchi
2018/0372047 A1 * 12/2018 Jeannel ..... F02M 61/1806
2020/0370526 A1 * 11/2020 Teng ..... F02M 51/061

FOREIGN PATENT DOCUMENTS

CN 2557811 Y 6/2003
CN 201763489 U 3/2011
CN 102465805 A 5/2012
CN 102748175 A 10/2012
CN 203161403 U 8/2013
CN 103732907 A 4/2014
DE 102010061812 A1 5/2012
EP 1482170 A1 12/2004
JP 2014181611 A 9/2014
WO 2015122231 A1 8/2015

* cited by examiner

SINGLE-HOLE FUEL ATOMIZATION AND INJECTION DEVICE AND FRONT-FACING ATOMIZATION STRUCTURE THEREOF

The present application is a National Phase entry of PCT Application No. PCT/CN2018/084176, filed on Apr. 24, 2018, which claims the priority to Chinese Patent Application 201711193782.5, entitled "SINGLE-HOLE ATOMIZATION FUEL INJECTOR AND FRONT ATOMIZATION STRUCTURE THEREOF" filed on Nov. 24, 2017, the entire contents of which are incorporated herein by reference.

FIELD

The present application relates to the technical field of fuel injectors, in particular to a front atomization structure of a single-hole atomization fuel injector. The present application also relates to a single-hole atomization fuel injector including the front atomization structure.

BACKGROUND

With the development of China's machinery industry, more and more machinery equipment has been widely used.

In the automobile manufacturing industry, there are thousands of types of auto parts. Taking a fuel injector of an engine as an example, the fuel injector belongs to a fuel injection system, and the fuel injection system refers to a fuel supply device that uses the fuel injector to directly inject a certain amount of fuel into a cylinder or an intake port under a certain pressure. According to different types of injected fuel, fuel injection systems can be divided into a gasoline injection system, a diesel injection system, a gas fuel injection system, etc. According to different control methods, fuel injection systems can be divided into a mechanical control type, an electronical control type and an electromechanical hybrid control type.

At present, an electronically controlled fuel injector is widely used. The electronically controlled fuel injector accepts the fuel injection pulse signal sent by ECU to precisely control the fuel injection quantity. The spray characteristics of the fuel injector include atomization particle size, oil mist distribution, oil beam direction, range and diffusion cone angle. There are many types of the fuel injectors, and the parts on the fuel injectors are relatively complicated. For the electronically controlled fuel injector, the atomization structure is a very important part.

In the conventional technology, the atomization structure of the electronically controlled fuel injector mainly includes a valve body and a valve hole (or an injection hole), etc. When a valve core on the valve seat is lifted by an electromagnetic drive mechanism or other equivalent drive mechanisms, the fuel, for example the gasoline, passes through the valve hole, since the diameter of the valve hole is very small, which may be an order of $10^{-4}$ m. When the fuel passes through the valve hole, the pressure increases sharply, and the liquid fuel will generate an atomization effect, forming a large number of tiny atomization particles that are flushed into the combustion chamber of the cylinder, which are in good contact with and mixed with the air, and facilities improving the combustion efficiency. However, in the conventional technology, because the shape of the injection hole of the electronically controlled fuel injector is circular or annular, the effect of the fuel atomization is poor, the particle size of the atomization particle is large, liquid beams are easily formed, and the atomization fineness is low.

Therefore, how to improve the fineness of the fuel atomization, refine the particle size of atomization particles, and improve the effect of the fuel atomization are technical problems needed to be solved urgently by those skilled in the art.

SUMMARY

One object of the present application is to provide a front atomization structure of a single-hole atomization fuel injector, which can improve the fineness of fuel atomization, refine the particle size of the atomization particles, and improve the effect of the fuel atomization. Another object of the present application is to provide a single-hole atomization fuel injector including the front atomization structure.

In order to solve the above problem, a front atomization structure of a single-hole atomization fuel injector is provided according to the present application, which includes a tube body and a mounting sleeve provided in the tube body, a valve seat for accommodating a valve core is mounted in one end of the mounting sleeve, and a valve hole is provided at a bottom of the valve seat. The front atomization structure of the single-hole atomization fuel injector further includes a fluid distributing member, a fluid-through member, a fluid swirling member and a metering member, which are all mounted in the other end of the mounting sleeve, the fluid distributing member abuts a bottom surface of the valve seat, the fluid-through member abuts a bottom surface of the fluid distributing member, the fluid swirling member abuts a bottom surface of the fluid-through member, and the metering member abuts a bottom surface of the fluid swirling member;

the fluid distributing member is provided with multiple fluid diverting slots extending in radial directions for distributing fluid beam passing through the valve hole into multiple strands;

the fluid-through member is provided with multiple fluid-through holes, and a projection of each of the fluid-through holes on a horizontal plane and a projection of the respective fluid diverting slot on the horizontal plane have an overlapping part;

the fluid swirling member is provided with a fluid swirling hole, and the fluid swirling hole is further provided with multiple fluid swirling slots, which are in communication with the fluid swirling hole in a circumferential direction of the fluid swirling hole for generating turbulent flow when fluid passing through the fluid swirling slots, and a projection of each of fluid swirling slots on the horizontal plane and a projection of the respective fluid-through hole on the horizontal plane have an overlapping part; and the metering member is provided with a metering hole in an opening range of the fluid swirling hole for atomizing the fluid when the fluid passing through the metering hole.

Preferably, an inner end of each of the fluid diverting slots is in communication with each other.

Preferably, each of the fluid diverting slots has a shape of a rectangle with an equal size, and has an end side wall having an arc surface with a same curvature as an outer edge of the fluid distributing member.

Preferably, the number of the fluid diverting slots provided in the fluid distributing member is two, three, four or five, and the fluid diverting slots are evenly arranged along a circumferential direction of fluid distributing member.

Preferably, a number of the fluid-through holes is the same as a number of the fluid diverting slots, and the fluid-through holes are in a one-to-one correspondence with the fluid diverting slots; and each of the fluid-through holes is a rectangular hole with a width equal to a width of the respective fluid diverting slot and a length smaller than a length of the respective fluid diverting slot.

Preferably, arrangement positions of the fluid-through holes in the fluid-through member is the same as arrangement positions of the fluid diverting slots in the fluid distributing member, an end side wall of each of the fluid-through holes has an arc surface with the same curvature as an outer edge of the fluid-through member, and the projection of each of the fluid-through holes on the horizontal plane is located at an end of the projection of the respective fluid diverting slot on the horizontal plane.

Preferably, the number of the fluid swirling slots provided in the fluid swirling member is two, three, four, or five, and the fluid swirling slots are evenly arranged along the circumferential direction of the fluid swirling hole.

Preferably, each of the fluid swirling slots is a rectangular slot with a width of 0.1 mm to 2 mm, and has a length direction tangent to the fluid swirling hole.

Preferably, a diameter of the metering hole is 0.1 mm to 2 mm; a thickness of the fluid distributing member, a thickness of the fluid-through member and a thickness of the fluid swirling member all are 0.2 mm to 2 mm, and a thickness of the metering member is 0.1 mm to 0.5 mm.

A single-hole atomization fuel injector is further provided according to the present application, which includes a housing and a front atomization structure provided in the housing, where the front atomization structure is specifically the front atomization structure according to any one of the above.

The front atomization structure of the single-hole atomization fuel injector provided according to the present application mainly includes a tube body, a mounting sleeve, a valve seat, a fluid distributing member, a fluid-through member, a fluid swirling member and a metering member. The mounting sleeve is mounted in the tube body, and a valve seat is mounted in one end of the mounting sleeve, and a valve hole is provided in the valve seat to communicate with the other end of the mounting sleeve, and the other end of the mounting sleeve is provided with the fluid distributing member, the fluid-through member, the fluid swirling member and the metering member, and the fluid distributing member, the fluid-through member, the fluid swirling member and the metering member abut with each other and are laid from top to bottom. The fluid distributing member is provided with multiple fluid diverting slots, which extend in radial directions and can distribute fluid beam passing through the valve hole into multiple strands. The fluid-through member is provided with multiple fluid-through holes, which can introduce the distributed fluid into the fluid distributing slots, and further restrict the fluid distribution. The fluid swirling member is provided with a fluid swirling hole and multiple fluid swirling slots in communication with the fluid swirling hole, so as to generate turbulent flow when fluid passing through the fluid swirling slots. Each of the fluid swirling slots can introduce the fluid in the fluid-through holes, and when this part of fluid passes through the fluid swirling slots, the bottom of the fluid swirling slots are blocked by the metering member, this part of the fluid will quickly generate a violent impact after hitting the bottom of the fluid swirling slots, thus forming a turbulent flow with a large Reynolds number (the fluid will form a turbulent flow with a smaller Reynolds number after a preliminary diversion of the fluid diverting slots and a deep diversion of the fluid-through holes), and converge into the fluid swirling hole along the swirling direction of the fluid swirling slots. The diameter of the metering hole is very small. When the fuel and other fluids pass through the metering hole, the pressure increases sharply, which can generate an atomization effect. When the turbulent fluid beam passes through the fluid swirling holes and then passes through the metering hole, the atomization effect will be significantly improved, the liquid atomization is more thorough, the particle size of the atomization is finer, and the effect of the fuel atomization is improved. When the front atomization structure is applied to the engine cylinder, it facilitates the mixing of fuel and air and facilitates full combustion, thereby avoiding carbon accumulation in the cylinder and improving the cleanliness of vehicle emissions.

BRIEF DESCRIPTION OF THE DRAWING

For clearer illustration of the technical solutions according to embodiments of the present disclosure or conventional techniques, hereinafter are briefly described the drawings to be applied in embodiments of the present disclosure or conventional techniques. Apparently, the drawings in the following descriptions are only some embodiments of the present disclosure, and other drawings may be obtained by those skilled in the art based on the provided drawings without creative efforts.

REFERENCE NUMERALS IN FIGS. 1 TO 6

| | | | |
|---|---|---|---|
| 1 | tube body, | 2 | valve seat, |
| 201 | valve hole, | 3 | fluid swirling member, |
| 301 | fluid swirling hole, | 302 | fluid swirling slot, |
| 4 | metering member, | 401 | metering hole, |
| 5 | valve core, | 6 | fluid distributing member, |
| 601 | fluid diverting slot, | 7 | fluid-through member, |
| 701 | fluid-through hole, | 8 | mounting sleeve. |

DETAIL DESCRIPTION

Figure 1:
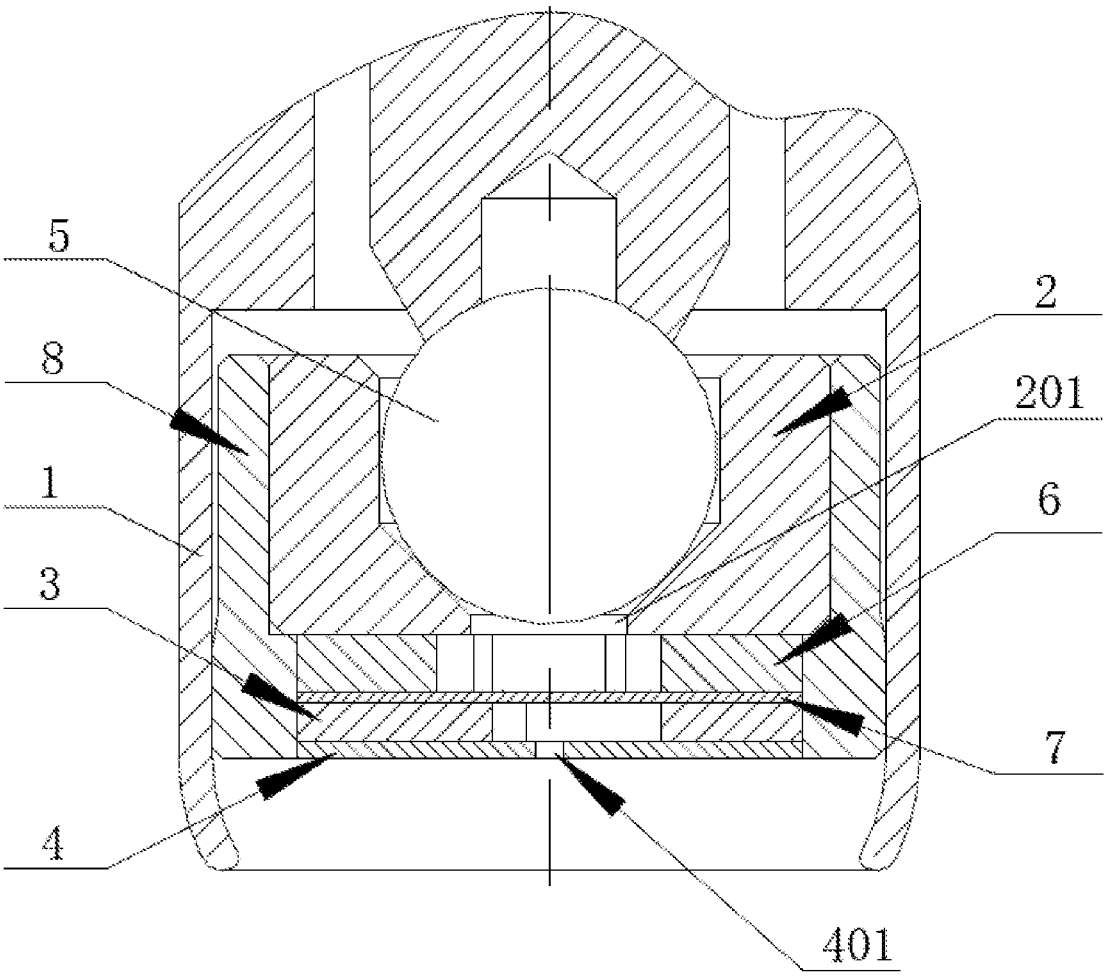
FIG. 1 is a schematic view showing an overall structure according to an embodiment of the present application.

The technical solutions according to embodiments of the present application are described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application Referring to FIG. 1, FIG. 1 is the schematic view showing the overall structure according to the embodiment of the present application.

According to the embodiment of the present application, the front atomization structure of the single-hole atomization fuel injector mainly includes a tube body 1, a mounting sleeve 8, a valve seat 2, a fluid distributing member 6, a fluid-through member 7, a fluid swirling valve 3 and a metering member 4.

The tube body 1 is generally a housing of the single-hole atomization fuel injector, which may be of a round tube or a cylinder.

The mounting sleeve 8 is provided in the tube body 1, and the valve seat 2 is mounted in one end of the mounting sleeve 8. The valve seat 2 is mainly used for mounting a valve core 5, and a valve hole 201 is provided in the valve seat 2 for communicating with another end of the mounting sleeve 8, which facilitates the fluid flowing from one end of the mounting sleeve 8 into another end. Of course, the valve seat 2 and the mounting sleeve 8 may also be integratedly designed to form a large valve seat with two mounting slots. One of the two mounting slots may be used for mounting the valve core 5, and the other of the two mounting slots is used for mounting the fluid distributing member 6, the fluid-through member 7, the fluid swirling member 3 and the metering member 4.

The fluid distributing member 6, the fluid-through member 7, the fluid swirling member 3 and the metering member 4 are mounted in the other end of the mounting sleeve 8. The fluid distributing member 6, the fluid-through member 7, the fluid swirling member 3 and the metering member 4 abut each other, and are laid from top to bottom. That is, the fluid distributing member 6 abuts a bottom surface of the valve seat 2, the fluid-through member 7 abuts a bottom surface of the fluid distributing member 6, the fluid swirling member 3 abuts a bottom surface of the fluid-through member 7, and the metering member 4 abuts a bottom surface of the fluid swirling member 3.

The fluid distributing member 6 is provided with multiple fluid diverting slots 601. Each of the fluid diverting slots 601 extends in a radial direction of the fluid distributing member 6, which is mainly used for diverting fluid beam passing through the valve hole 201 into multiple strands, and a main fluid beam is preliminarily diverted.

The fluid-through member 7 is provided with multiple fluid-through holes 701. A projection of each of the fluid-through holes 701 on a horizontal plane and a projection of the respective fluid diverting slot 601 on the horizontal plane have an overlapping part. That is to say, the fluid-through holes 701 may introduce the diverted fluid in the fluid diverting slots, and further restrict the fluid diversion. At the same time, since the fluid-through holes 701 can only introduce part of the fluid from the fluid diverting slots 601, most of the main fluid beam is blocked by the fluid-through member 7 at the bottom of the fluid diverting slots 601 when the main fluid beam enters the fluid diverting slots 601, and shock and vibration in the fluid are generate, and the diverted fluid forms a turbulent flow with a small Reynolds number for the first time.

The fluid swirling member 3 is provided with a fluid swirling hole 301 and multiple fluid swirling slots 302 in communication with the fluid swirling hole 301. The fluid swirling hole 301 may generally be arranged at a center position of the fluid swirling member 3. The fluid swirling slots 302 are arranged in a circumferential direction of the fluid swirling hole 301, and a projection of each of fluid swirling slots 302 on the horizontal plane and a projection of the respective fluid-through hole 701 on the horizontal plane have an overlapping part. That is to say, a part of the diverted fluid in the fluid-through holes 701 can be directly introduced into the fluid swirling slots 302, and another part of the diverted fluid is blocked by the fluid swirling member 3 at the bottom of the fluid-through holes 701, which will generate shock and vibration in the fluid, so that the degree of turbulence of the diverted fluid is deepened and the Reynolds number is increased.

Figure 5:
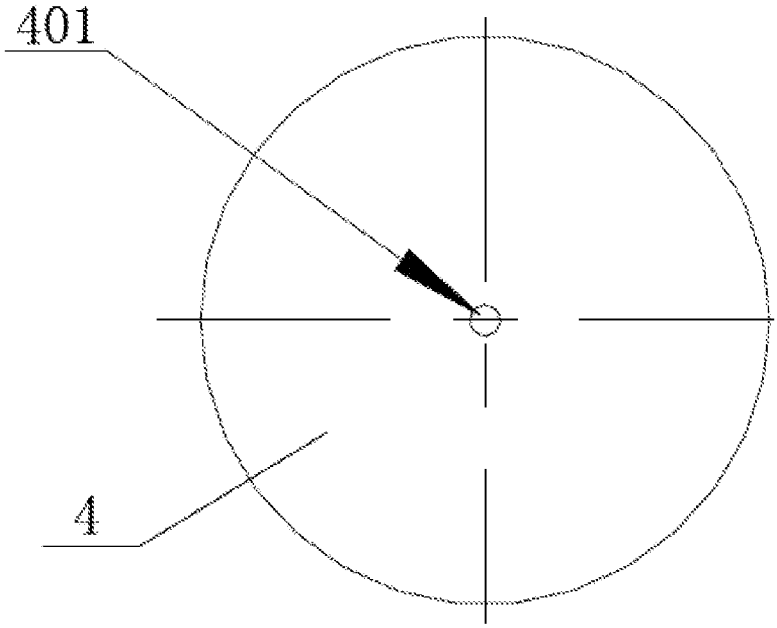
FIG. 5 is a schematic view showing a specific structure of a metering member shown in FIG. 1.

As shown in FIG. 5, FIG. 5 is a schematic view showing the specific structure of the metering member shown in FIG. 1.

The metering member 4 is provided with a metering hole 401, which is located within an opening range of the fluid swirling hole 301, and may generally be located at the center position of the metering member 4. The diameter of the metering hole 401 is very small. When the fuel and other fluids pass through the metering hole 401, the pressure increases sharply, and thus an atomization effect is generated. After the diverted fluid with the deepened turbulent flow enters the fluid swirling slots 302, since the bottom of the fluid swirling slots 302 is blocked by the metering member 4, a violent impact will quickly generate after the diverted fluid hitting the bottom of the fluid swirling slots 302, thus a turbulent flow with a larger Reynolds number is formed. Finally the diverted fluid converges into the fluid swirling hole 301 along the swirling directions of the fluid swirling slots 302, and then sprays out from the metering hole 401 to form a stable spray distribution angle. The atomization effect is significantly improved, the liquid atomization is more thorough, the particle size of the atomization particle is finer, the inlet pressure of the liquid (fuel or urea) is in a range of 0.3 Mpa to 1 Mpa, the SMD (Sauter mean diameter) is within 80 μm to 35 μm, and the effect of the fuel atomization is improved. When applied to the engine cylinder, it facilitates the mixing of fuel and air and facilitates full combustion, thereby avoiding carbon accumulation in the cylinder and improving the cleanliness of vehicle emissions.

Figure 2:
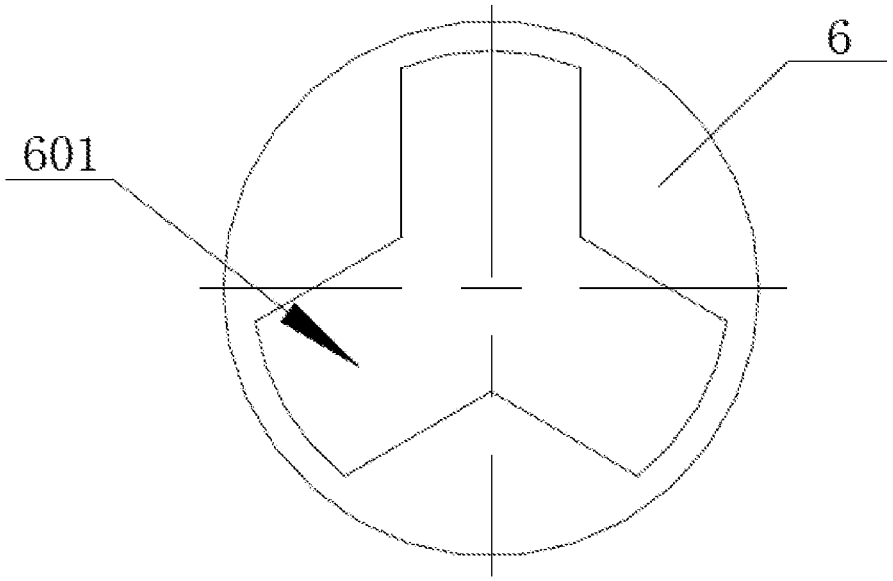
FIG. 2 is a schematic view showing a specific structure of a fluid distributing member shown in FIG. 1.

As shown in FIG. 2, FIG. 2 is a schematic view showing the specific structure of the fluid distributing member shown in FIG. 1.

In a preferred embodiment of the fluid diverting slots 601, considering that the valve hole 201 is generally provided at the center position of the valve seat 2, in order to smoothly divert the main fluid beam in the valve hole 201, an inner end of each of the fluid diverting slots 601 on the fluid distributing member 6 is in communication with each other, that is, forming a shape that is hollow in the middle and diverges outward. Of course, the inner ends of the fluid diverting slots 601 may not be in communication with each other, but they need to be arranged within a certain radius.

Further, each of the fluid diverting slots 601 may be a shape of a rectangle with equal size, that is, the length size of each rectangle is equal, the width size of each rectangle is equal, and the height (or thickness) is the thickness of the fluid distributing member 6. In addition, the end (the end away from the center of the circle) side wall of each fluid diverting slot 601 may be set as an arc surface with the same curvature as an outer edge of the fluid distributing member 6, which facilitates design and manufacturing. Of course, the specific size of each fluid diverting slot 601 may be different from each other, and the shape of the end side wall may also be changed arbitrarily.

Furthermore, in order to improve the diversion effect while ensuring the structural strength, the number of the fluid diverting slots 601 provided in the fluid distributing member 6 may be 2 to 5. In order to ensure forming the diversion effect with stable angular distribution to the main fluid beam, the fluid diverting slots 601 may be evenly arranged along the circumferential direction of the fluid distributing member 6. For example, three fluid diverting slots 601 may be provided on the fluid distributing member 6, and a circle center angle between the two adjacent fluid diverting slots 601 is 120°.

Figure 3:
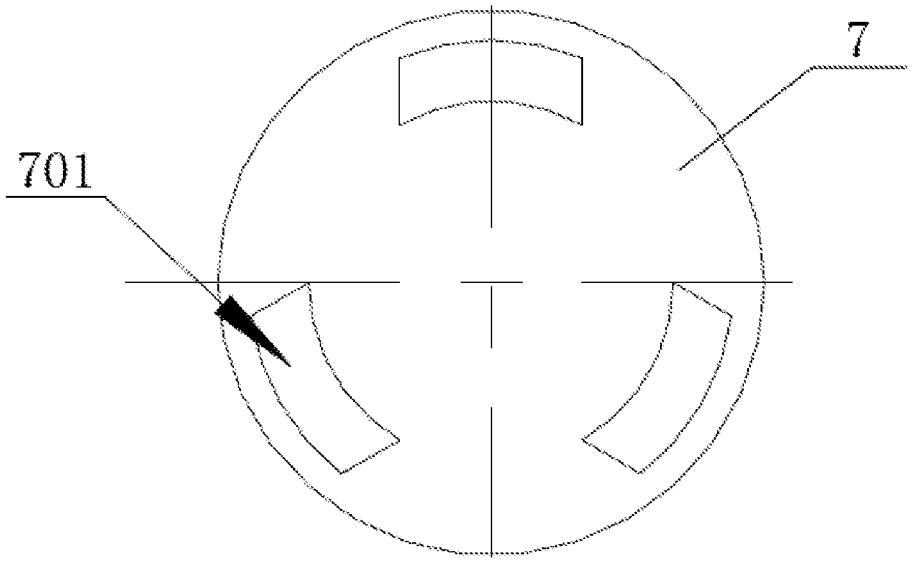
FIG. 3 is a schematic view showing a specific structure of a fluid-through member shown in FIG. 1.

As shown in FIG. 3, FIG. 3 is a schematic view showing the specific structure of the fluid-through member shown in FIG. 1.

In a preferred embodiment of the fluid-through holes 701, the number of the fluid diverting slots 601 provided in the fluid-through member 7 may be similarly 2 to 5, and the number of the fluid-through holes 701 is generally equal to the number of fluid diverting slots 601, and the fluid-through holes 701 are in a one-to-one correspondence with the fluid diverting slots 601. Moreover, each of the fluid-through holes 701 may also a rectangular hole with a width equal to a width of the respective fluid diverting slot 601 and a length smaller than a length of the respective fluid diverting slot 601, so as to increase the turbulence, for example, the length of each of the fluid-through holes 701 may be ⅓ or ¼ of the length of the respective fluid diverting slot 601.

Further, a distribution position of each of the fluid-through holes 701 in the fluid-through member 7 may be the same as an arrangement position of each of the fluid diverting slots 601 in the fluid distributing member 6, that is, the range of the center angle of the fluid-through holes 701 is the same as the range of the center angle of the fluid diverting slots 601. The projection of each of the fluid-through holes 701 on the horizontal plane is located at an end of the projection of the respective fluid diverting slot 601 on the horizontal plane, that is, each fluid-through hole 701 corresponds to a part of each fluid diverting slot 601. The end side wall of each fluid-through hole 701 may be the same as that of each fluid diverting slots 601, and is set to be an arc surface with the same curvature as the outer edge of the fluid-through member 7.

Figure 4:
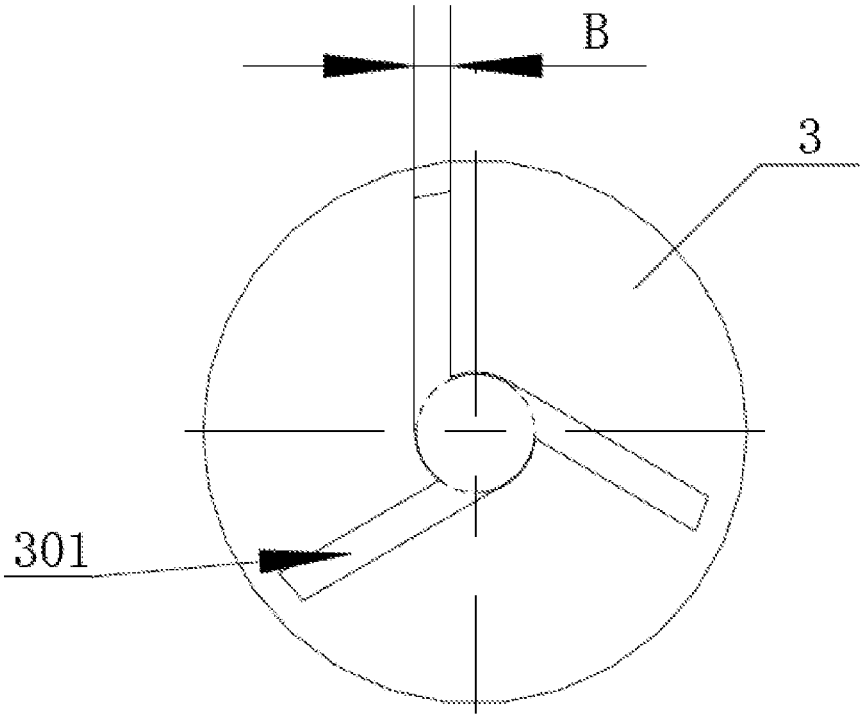
FIG. 4 is a schematic view showing a specific structure of a fluid swirling member shown in FIG. 1.

As shown in FIG. 4, FIG. 4 is a schematic view showing the specific structure of the fluid swirling member shown in FIG. 1.

In a preferred embodiment of the fluid swirling slots, the number of the fluid swirling slots 302 provided in the fluid swirling member 3 may be 2 to 5, and may be the same with the number of the fluid diverting slots 601 or the fluid-through holes 701, and the fluid swirling slots 302 may be evenly arranged along the circumferential direction of the fluid swirling hole 301. For example, three fluid swirling slots 302 are provided in the fluid swirling member 3 at the same time. Thus, the circle center angle between two adjacent fluid swirling slots 302 is 120°, and other number of the fluid swirling slots 302 can be deduced by analogy. Of course, it is also feasible that the fluid swirling slots 302 are unevenly arranged.

Further, each fluid swirling slot 302 may be specifically rectangular, and has a length direction tangent to the fluid swirling hole 301. In this way, when the diverted fluid beam hits the bottom of each fluid swirling slot 302 and scatters, it facilitates the scattered fluid quickly forming a swirl with a stable distribution angle compared with other relative positional relationship, and the swirl has a faster formation speed and more stable fluid diverter angle. Of course, it is also feasible that the length direction of each fluid swirling slot 302 deviates from the tangential direction of the swirl hole 301 by a certain angle.

Furthermore, in order to ensure that a sufficient proportion of the swirl flow can be formed in the fluid swirling slots 302, the slot width of each fluid swirling slot 302 may be set to be 0.1 mm to 2 mm. Of course, this data may be adjusted flexibly in face of different fluids or different injection requirements.

In addition, the diameter of the metering hole 401 may generally be 0.1 mm to 2 mm. At the same time, the thickness of the fluid distributing member 6, the fluid swirling member 3, and the fluid-through member 7 may all be equal, generally 0.2 mm to 2 mm, and the thickness of the metering member 4 may be 0.1 mm to 0.5 mm.

Figure 6:
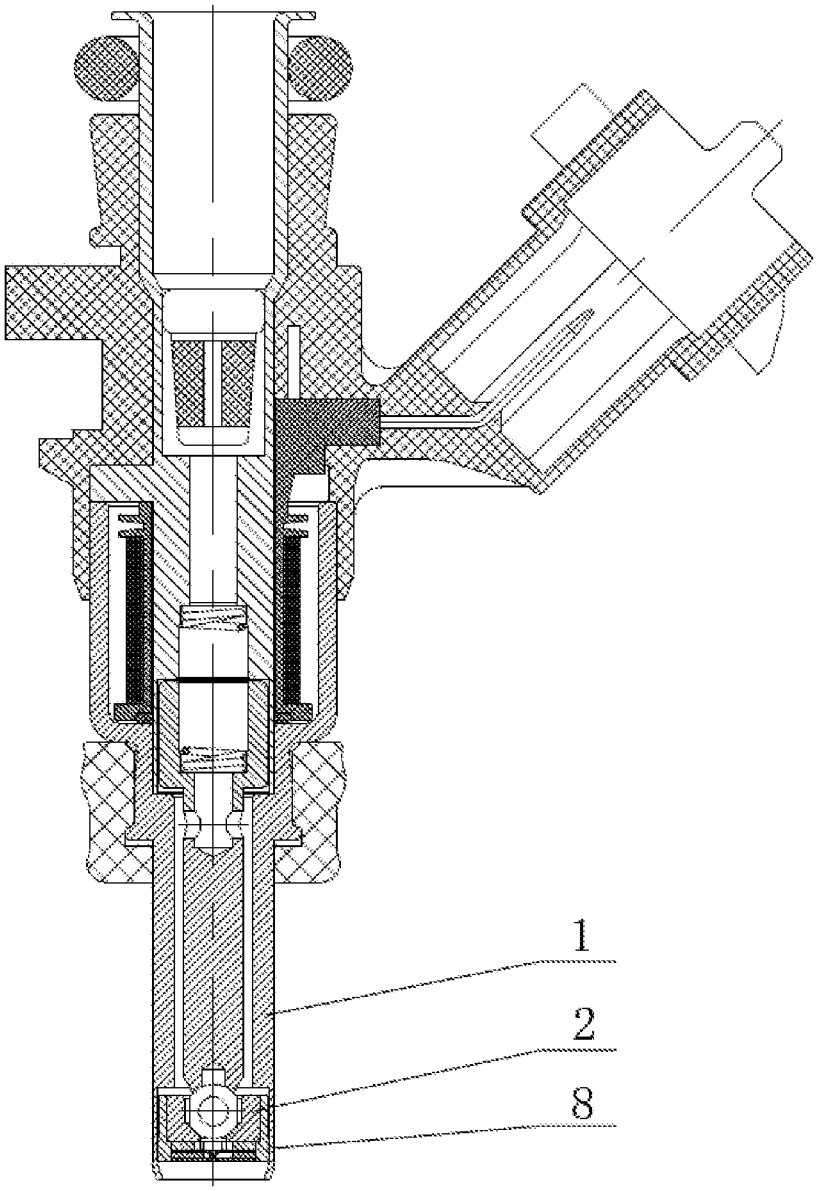
FIG. 6 is a schematic view showing a structure of a fuel injector according to an embodiment of the present application.

As shown in FIG. 6, FIG. 6 is a schematic view showing the structure of a fuel injector according to an embodiment of the present application.

A single-hole atomization fuel injector is further provided according to the present application, which mainly includes a housing and a front atomization structure provided in the housing, the front atomization structure is the same as the above related content, and will not be repeated here. It should be noted that the front atomization structure according to this embodiment can be applied not only to the fuel injector of the engine combustion system, but also to the metering and atomization of the urea solution of the engine exhaust system.

Based on the above description of the disclosed embodiments, the person skilled in the art can carry out or use the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

What is claimed is:

1. A front atomization structure of a single-hole atomization fuel injector, comprising:

a tube body, and a mounting sleeve provided in the tube body, wherein a valve seat for accommodating a valve core is mounted in one end of the mounting sleeve, and a valve hole is provided at a bottom of the valve seat, wherein the front atomization structure of the single-hole atomization fuel injector further comprises a fluid distributing member, a fluid-through member, a fluid swirling member and a metering member, which are all mounted in an other end of the mounting sleeve, the fluid distributing member abuts a bottom surface of the valve seat, the fluid-through member abuts a bottom surface of the fluid distributing member, the fluid swirling member abuts a bottom surface of the fluid-through member, and the metering member abuts a bottom surface of the fluid swirling member;

wherein the fluid distributing member is provided with a plurality of fluid diverting slots extending in radial directions for distributing fluid beam passing through the valve hole into a plurality of strands;

the fluid-through member is provided with a plurality of fluid-through holes, and a first projection of each of the fluid-through holes on a horizontal plane and a second projection of the respective fluid diverting slot on the horizontal plane have two overlapping parts, i.e., a first overlapping part and a second overlapping part;

the fluid swirling member is provided with a fluid swirling hole, and the fluid swirling hole is further provided with a plurality of fluid swirling slots in communication with the fluid swirling hole in a circumferential direction of the fluid swirling hole for generating turbulent flow when fluid passes through the fluid swirling slots, and a third projection of each of fluid swirling slots on the horizontal plane and the first projection of the respective fluid-through hole on the horizontal plane have two overlapping parts, i.e., a third overlapping part and a fourth overlapping part; and the metering member is provided with a metering hole in an opening range of the fluid swirling hole for atomizing a fluid when the fluid passing through the metering hole, wherein an inner end of each of the fluid diverting slots is in communication with each other and each of the fluid diverting slots has a shape of a rectangle with an equal size, wherein arrangement positions of the fluid-through holes in the fluid-through member are the same as arrangement positions of the fluid diverting slots in the fluid distributing member, wherein the first projection of each of the fluid-through holes on the horizontal plane is located at an end of the second projection of the respective fluid diverting slot on the horizontal plane.

2. The front atomization structure according to claim 1, wherein each of the fluid diverting slots has an end side wall having an arc surface with a same curvature as an outer edge of the fluid distributing member.

3. A single-hole atomization fuel injector, comprising a housing and a front atomization structure provided in the housing, wherein the front atomization structure is the front atomization structure according to claim 2.

4. The front atomization structure according to claim 2, wherein the number of the fluid diverting slots provided in the fluid distributing member are two, three, four or five, and the fluid diverting slots are evenly arranged along a circumferential direction of fluid distributing member.

5. A single-hole atomization fuel injector, comprising a housing and a front atomization structure provided in the housing, wherein the front atomization structure is the front atomization structure according to claim 4.

6. The front atomization structure according to claim 4, wherein a number of the fluid-through holes is the same as a number of the fluid diverting slots, and the fluid-through holes are in a one-to-one correspondence with the fluid diverting slots; and each of the fluid-through holes is a rectangular hole with a width equal to a width of the respective fluid diverting slot and a length smaller than a length of the respective fluid diverting slot.

7. A single-hole atomization fuel injector, comprising a housing and a front atomization structure provided in the housing, wherein the front atomization structure is the front atomization structure according to claim 6.

8. The front atomization structure according to claim 6, wherein an end side wall of each of the fluid-through holes has an arc surface with a same curvature as an outer edge of the fluid-through member.

9. A single-hole atomization fuel injector, comprising a housing and a front atomization structure provided in the housing, wherein the front atomization structure is the front atomization structure according to claim 8.

10. The front atomization structure according to claim 8, wherein the number of the fluid swirling slots provided in the fluid swirling member is two, three, four, or five, and the fluid swirling slots are evenly arranged along the circumferential direction of the fluid swirling hole.

11. A single-hole atomization fuel injector, comprising a housing and a front atomization structure provided in the housing, wherein the front atomization structure is the front atomization structure according to claim 10.

12. The front atomization structure according to claim 10, wherein each of the fluid swirling slots is a rectangular slot with a width of 0.1 mm to 2 mm, and has a length direction tangent to the fluid swirling hole.

13. A single-hole atomization fuel injector, comprising a housing and a front atomization structure provided in the housing, wherein the front atomization structure is the front atomization structure according to claim 12.

14. The front atomization structure according to claim 12, wherein a diameter of the metering hole is 0.1 mm to 2 mm; a thickness of the fluid distributing member, a thickness of the fluid-through member and a thickness of the fluid swirling member all are 0.2 mm to 2 mm, and a thickness of the metering member is 0.1 mm to 0.5 mm.

15. A single-hole atomization fuel injector, comprising a housing and a front atomization structure provided in the housing, wherein the front atomization structure is the front atomization structure according to claim 14.

16. A single-hole atomization fuel injector, comprising a housing and a front atomization structure provided in the housing, wherein the front atomization structure is the front atomization structure according to claim 1.

* * * * *